US008714349B2

(12) United States Patent
Eddy

(10) Patent No.: US 8,714,349 B2
(45) Date of Patent: May 6, 2014

(54) DEVICE FOR THE DISPOSAL OF CONSUMED CHEWING GUM

(76) Inventor: Thomas G. Eddy, McMurray, PA (US)

( * ) Notice: Subject to any disclaimer, the term of this patent is extended or adjusted under 35 U.S.C. 154(b) by 201 days.

(21) Appl. No.: 13/398,154

(22) Filed: Feb. 16, 2012

(65) Prior Publication Data

US 2013/0168269 A1 Jul. 4, 2013

Related U.S. Application Data

(60) Provisional application No. 61/463,512, filed on Feb. 18, 2011.

(51) Int. Cl.
*B65D 71/00* (2006.01)

(52) U.S. Cl.
USPC ..... 206/233; 206/800; 53/473; 220/229

(58) Field of Classification Search
USPC ..... 53/473; 206/37, 702, 233, 494, 800, 206/359; 220/229; 232/43.1
See application file for complete search history.

(56) References Cited

U.S. PATENT DOCUMENTS 2,757,859 A * 8/1956 Holland ..... 232/43.2
4,244,478 A * 1/1981 Handman ..... 215/249
5,143,249 A * 9/1992 Saint Criq et al. ..... 221/34
7,563,468 B2 * 7/2009 Bougoulas et al. ..... 426/5
8,006,860 B2 * 8/2011 Klein ..... 220/503
8,526,802 B1 * 9/2013 Starns ..... 396/1
8,535,621 B2 * 9/2013 Iheme et al. ..... 422/501
2006/0000739 A1 * 1/2006 Kadish ..... 206/494
2010/0155272 A1 * 6/2010 Ottman et al. ..... 206/233

* cited by examiner

*Primary Examiner* — Anthony Stashick
*Assistant Examiner* — Raven Collins
(74) *Attorney, Agent, or Firm* — The Webb Law Firm

(57) ABSTRACT

A mechanical device for the disposal of consumed chewing gum includes a base having a recessed flanged collar at its top to accommodate a cap. The device further includes a rubber gasket, optional securing clips, a plug on the underside of the base, a paper tray, a locking insert, and a dispensing paper pack. The cap is fitted to the base by placing, snapping, or screwing the cap over the recessed flanged collar on the base. The cap has an opening traversing its top to allow the withdrawal of a single paper sheet to wrap consumed chewing gum for disposal. The paper tray is attached to the inside bottom portion of the cap. A gasket is mounted to the top inside portion of the base below the flanged collar for disposal of gum into the base cavity. The case can be emptied by removing the plug on the underside of the base.

20 Claims, 9 Drawing Sheets

DEVICE FOR THE DISPOSAL OF CONSUMED CHEWING GUM

CROSS-REFERENCE TO RELATED APPLICATIONS

The present application claims priority to the Provisional U.S. Patent Application No. 61/463,512, entitled "Device for the Disposal of Consumed Chewing Gum for Residential and Commercial Use" and filed on Feb. 18, 2011, the disclosure of which is incorporated herein by reference in its entirety.

BACKGROUND OF THE INVENTION

Field of the Invention

The present invention is directed to a mechanical device for the disposal of consumed chewing gum for residential and commercial use.

SUMMARY OF THE INVENTION

A hollow mechanical device for the disposal of consumed chewing gum may have a three-dimensional geometric shape of an elliptical paraboloid (i.e., in the shape of a traditional "gumdrop") and facing downward. The device may be divided into two portions so that the bottom portion (base) acts as the receptacle for the disposal of spent chewing gum and the top portion (cap) acts as a storage area and dispenser for pre-cut paper sheets to encase the gum for disposal. The underside of the base may be closed and contains a removable rubber plug for emptying the contents. The base at its top may have an indented flange, either threaded or unthreaded, where upon the cap, threaded or unthreaded, is securely seated and attached to the base. The user may remove a sheet of wrapping paper, wrap the consumed chewing gum and push it through a gasket into the base for disposal. The two-piece body of this device may be constructed of cast metal, plastic or ceramic. The device may have a round/tapered cylindrical and hollow (elipitical paraboloid) two-piece body. In one embodiment, the device may measure approximately 3⅝" in diameter at its base, 2¾" in diameter at the union plane of the base and cap at a height of 2⅝," then tapering to its top most point at 4" in height. These dimensions are for the purpose of an exemplary illustration and are based generally on the proportional dimensions of the geometric shape of an elliptical paraboloid, or traditional "gumdrop" shape.

In accordance with one embodiment, the device may include of a base having a recessed flange collar at its top. The flange collar may be either smooth or threaded at its top to accommodate the cap. The device may further include a rubber gasket, securing clips, a plug, a paper tray, a locking insert, and a dispensing paper pack.

DESCRIPTION OF THE PREFERRED EMBODIMENTS

Figure 1:
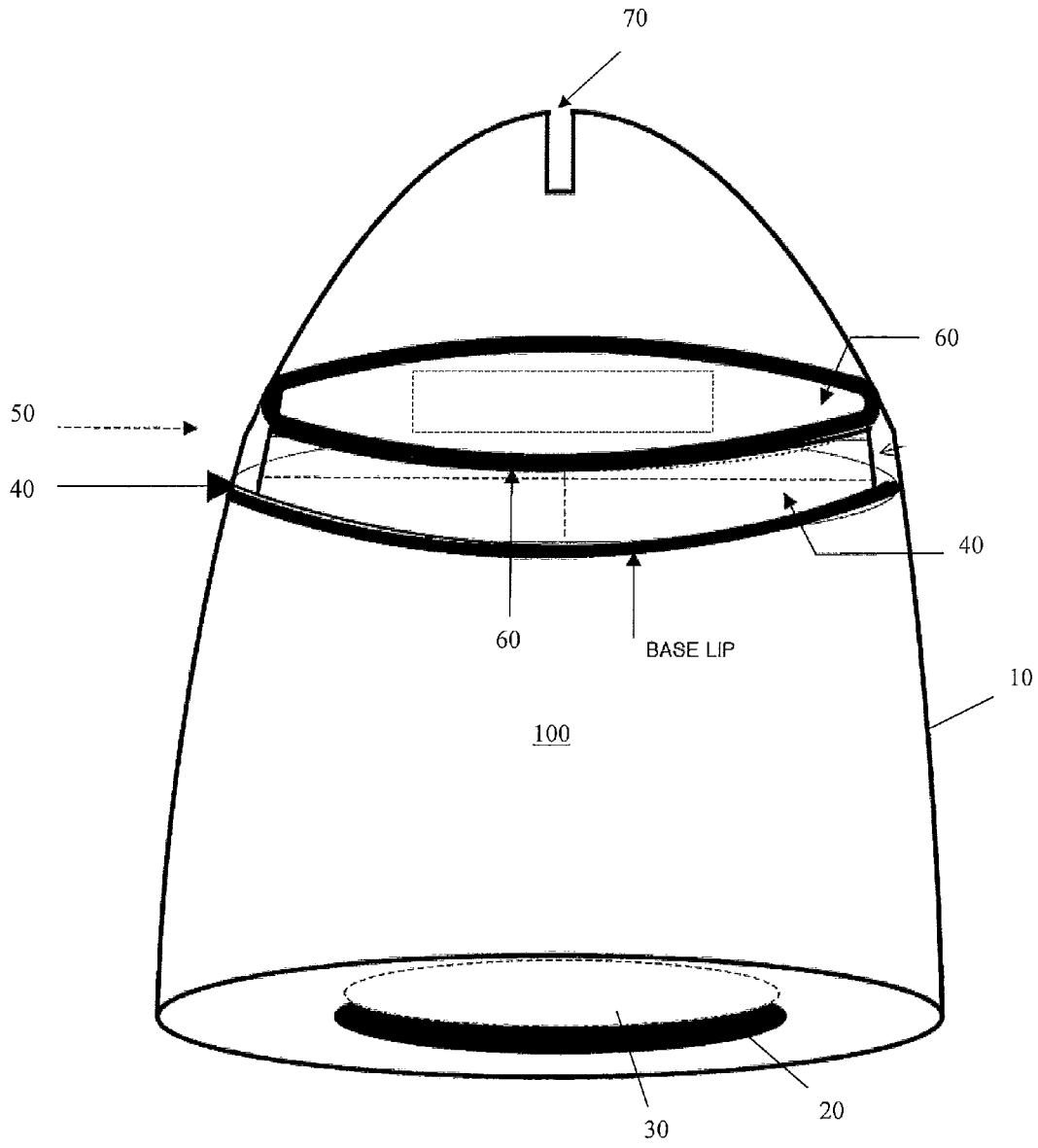
FIG. 1 is a front perspective view of a device for the disposal of consumed chewing gum in accordance with one embodiment of the present invention.
Figure 2A:
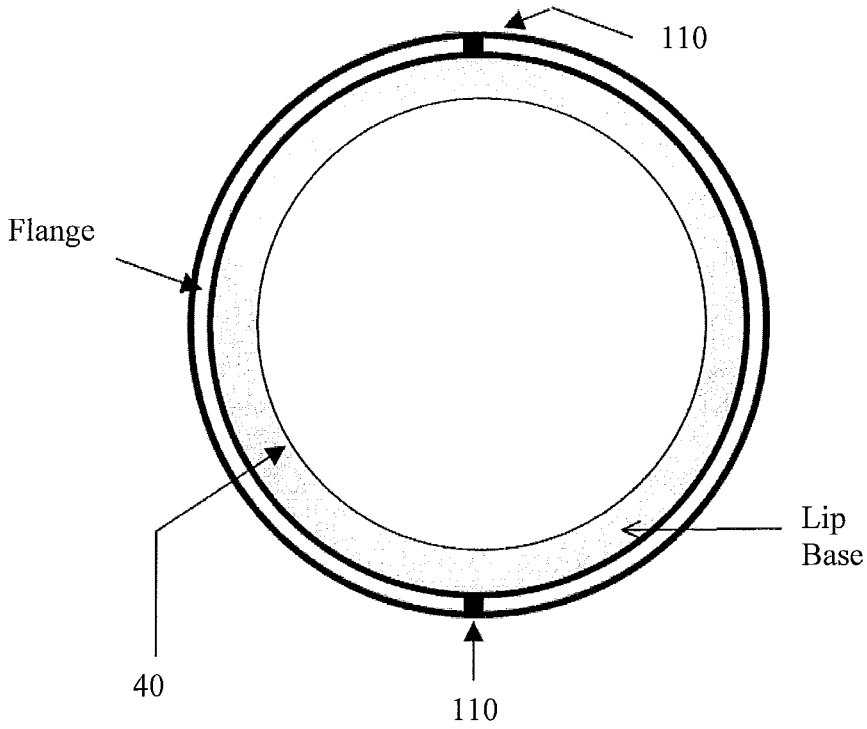
FIG. 2A is a top view of the base of the device shown in FIG. 1.
Figure 2B:
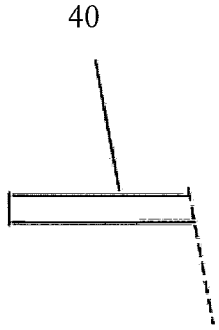
FIG. 2B is a side view of a rubber gasket insert.
Figure 2C:
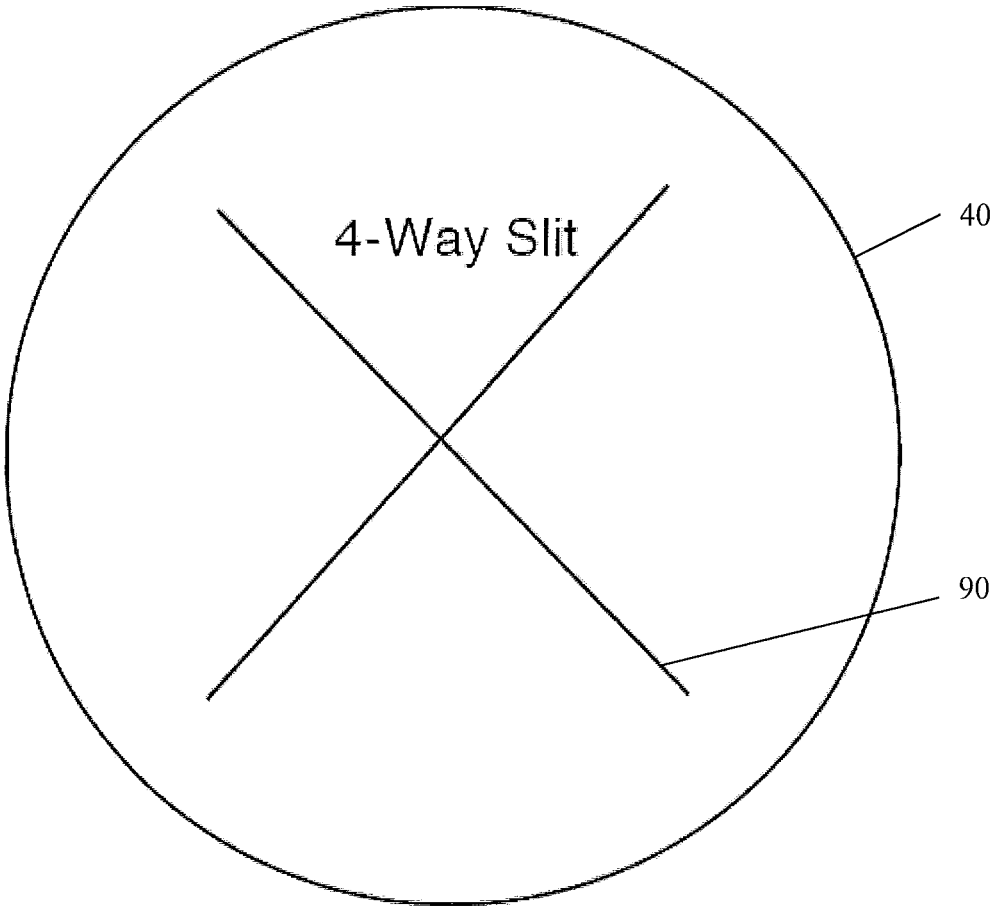
FIG. 2C is a top view of a rubber gasket insert.
Figure 2D:
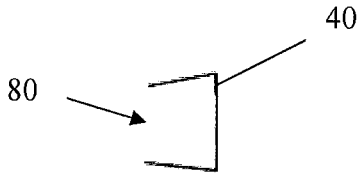
FIG. 2D is a side view of a portion of the rubber gasket.

For purposes of the description hereinafter, the terms "upper", "lower", "right", "left", "vertical", "horizontal", "top", "bottom", "lateral", "longitudinal", and derivatives thereof, shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Referring to the drawings in which like reference characters refer to like parts throughout the several views thereof, the present disclosure is generally directed to a device for the disposal of consumed chewing gum.

With reference to FIGS. 1-3C, the base 10 has a hollow, substantially cylindrical shape. In one embodiment, the base 10 measuring approximately 3⅝" in diameter at the bottom, symmetrically tapering to 2¾" in diameter near the top at a height of 2⅜" to a tapered flange inset ⅛" to a diameter of 2½", and ⅜" in height to a final diameter of 2⅜" and total height of 2¾". A hole 20 measuring 1½" in diameter is cut into the center bottom of the base 10 to allow for a plug 30. The base will have a lip ⅜" wide, ⅛" thick and recessed ⅜" from its top, attached to the inside wall of the base thus protruding ¼" from the edge of the flange wall to accommodate a rubber gasket 40. Primary design (excluding ceramic construction) would incorporate two (up to four) small securing clips mounted onto an unthreaded flange wall of the base, 180 degrees apart (or 120 degrees for three clips, 90 degrees for four clips) for additional securing of the cap to the base.

Figure 7:
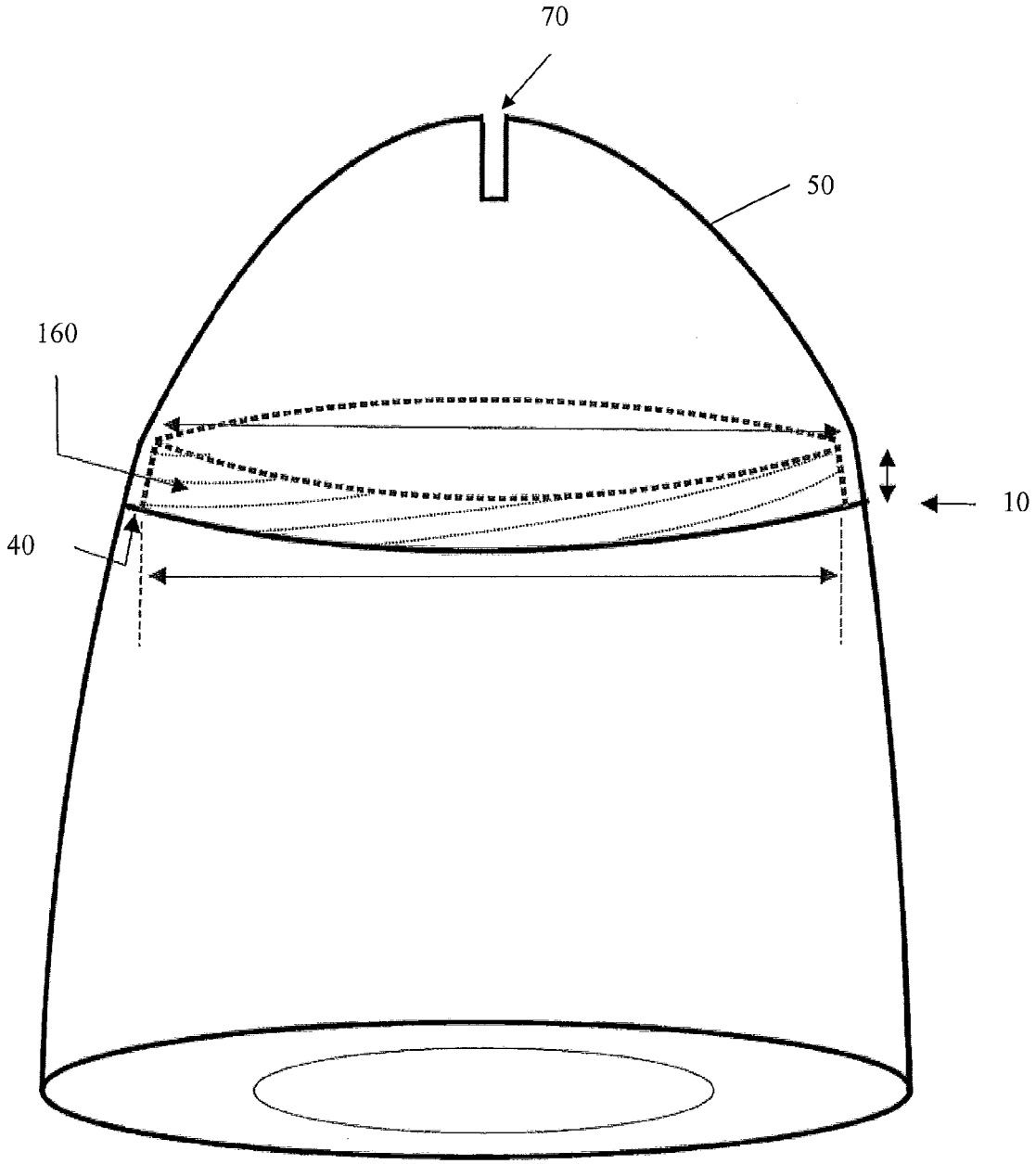
FIG. 7 is a perspective view of the device in accordance with another embodiment showing a threaded connection between the cap and the base.

With continuing reference to FIGS. 1-3C and with reference to FIG. 7, the cap 50 has a hollow, cylindrical shape. In one embodiment, the cap 50 measures approximately 2¾" in diameter at its bottom, symmetrically tapering to a rounded point at 1⅝" in height and fitting firmly over the smooth or threaded flange of the base top. The cap 50 is fitted with a paper tray 60. The cap 50 has a lip, ¼" wide, ⅛" thick, and recessed ½" from its bottom to accommodate the paper fray 60. The cap further includes a paper access opening 70, a rectangular slit measuring ¼" wide and extending across the precipus approximately ½" from the top dead center of the cap 50 in two opposing directions.

With reference to FIGS. 2A-2D, a round gasket 40 is also provided. In one embodiment, the gasket measures 2½" in diameter with a ⅛" deep and ¼" wide "U" channel 80 (shown in FIG. 2D) on its outer circumference to snugly fit to the lip of the base 10. The gasket 40 contains an "X" pattern of slits or cuts 90 beginning at the center point and physically separate the base 10 from the cap 50 allowing consumed chewing gum to be pushed through the slits 90 and discharged into the hollow disposal area 100 cavity of the base. The slits or cuts 90 in the rubber gasket 40 would be equally spaced at 0, 90, 180 and 270 degrees and stop ½" short of intersecting the outer edge of the gasket 40, so each slit "ray" 90 would measure 1" in length from the gasket's center point.

Figure 8:
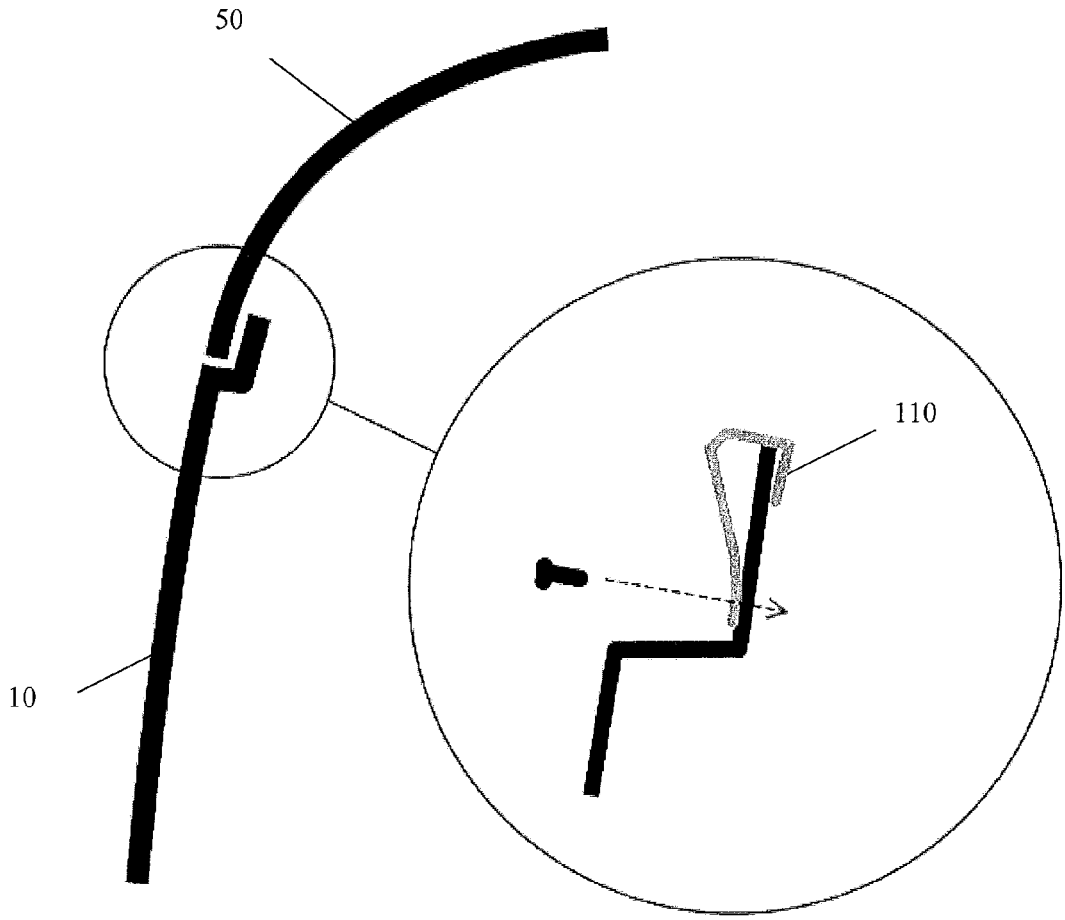
FIG. 8 is a detailed side view of the device shown in FIG. 7 depicting an exploded view of the securing clip mounting detail.

With reference to FIG. 8, two high-tension steel clips 110 are attached (screwed or soldered) to the outside flange wall of the base 10 to securely lock the cap 50 into position when the device is in the closed position.

Figure 5A:
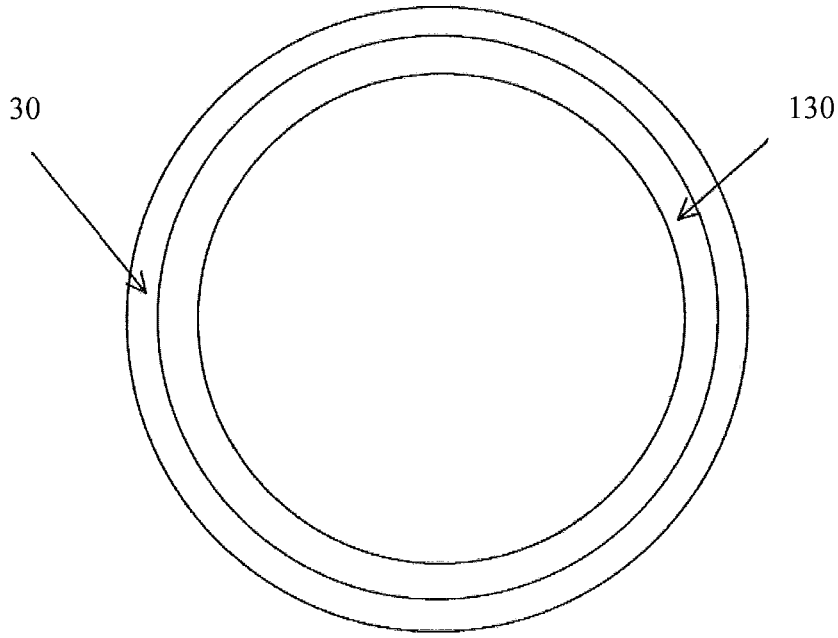
FIG. 5A is a top view of the rubber plug in accordance with one embodiment.
Figure 5B:
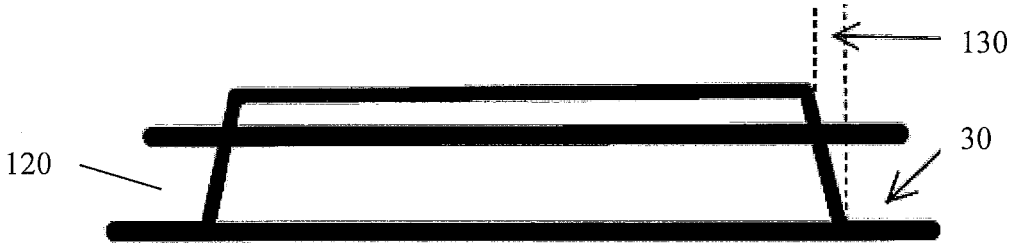
FIG. 5B is a side view of the plug shown in FIG. 5A.

With reference to FIGS. 5A-5B, a plug 30, desirably formed from plastic or ceramic, measures 2" in diameter, and ⅜" in height with a ¼" wide lip which overlaps the base underside. The actual plug fitting into the hole 20 in the base 10 would be then 1½" in diameter at its base tapering to 1⅜" in diameter at its top to securely fit into the 1½" hole cut into the bottom of the base, thereby providing a ¼" overlap onto the bottom of the base when properly secured. An inner or middle ring 120 measuring 1¾" in diameter on the plastic plug would also secure it to the base by providing a top lip 130, which would overlap the bottom inside of the base when inserted.

Figure 3A:
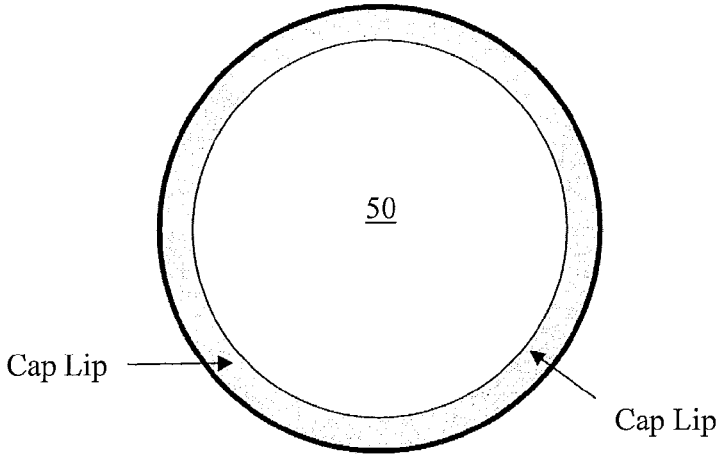
FIG. 3A is a bottom view of the cap of the device shown in FIG. 1.
Figure 3B:
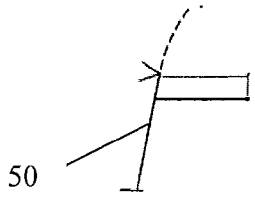
FIG. 3B is a side view of the cap showing the lip.
Figure 3C:
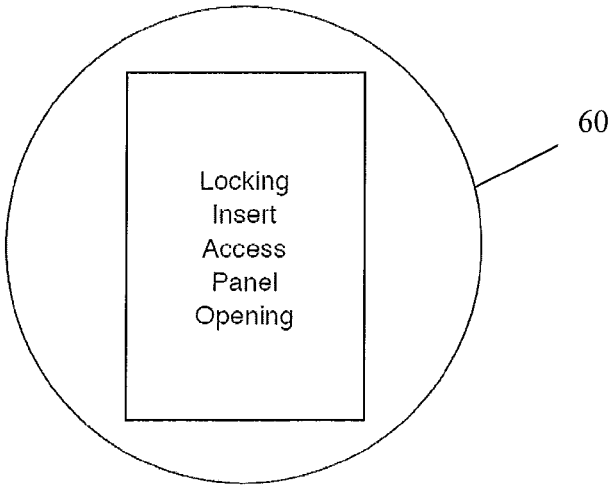
FIG. 3C shows a locking insert access panel opening on the cap.
Figure 4:
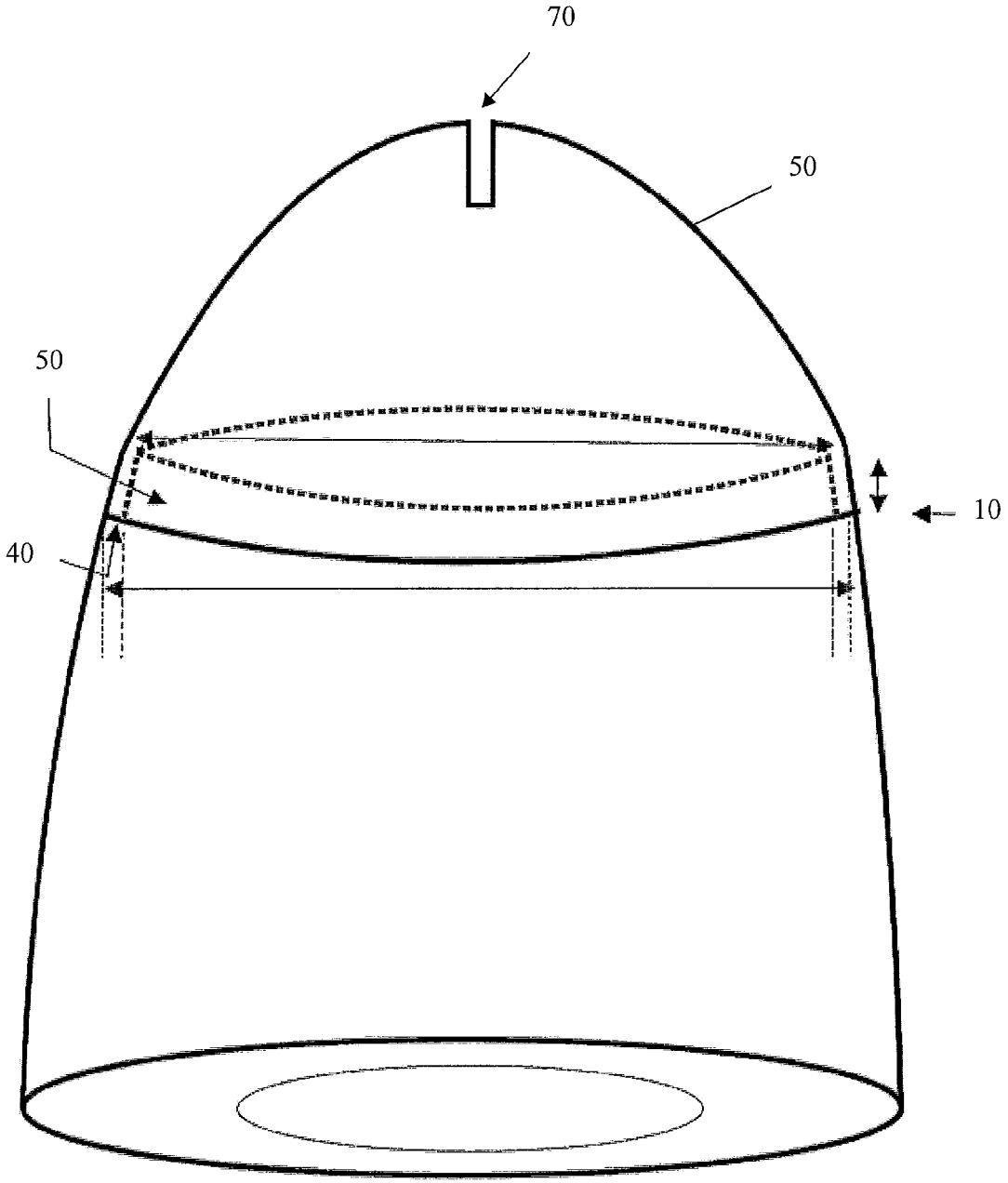
FIG. 4 is a perspective view of the device showing the flange collar design.

With reference to FIGS. 3A-3C, a paper tray 60 may have a round plastic construction, measuring 2½" in diameter and ⅛" thick, attached to the lip near the bottom of the cap with adhesive bonding. The tray 60 accommodates a flush mounted and removable locking insert 140, rectangular in shape with a clip on its length edge and traversing the bottom of the cap, and with a collar on its opposite side to hold the paper pack 150 in position.

Figure 6:
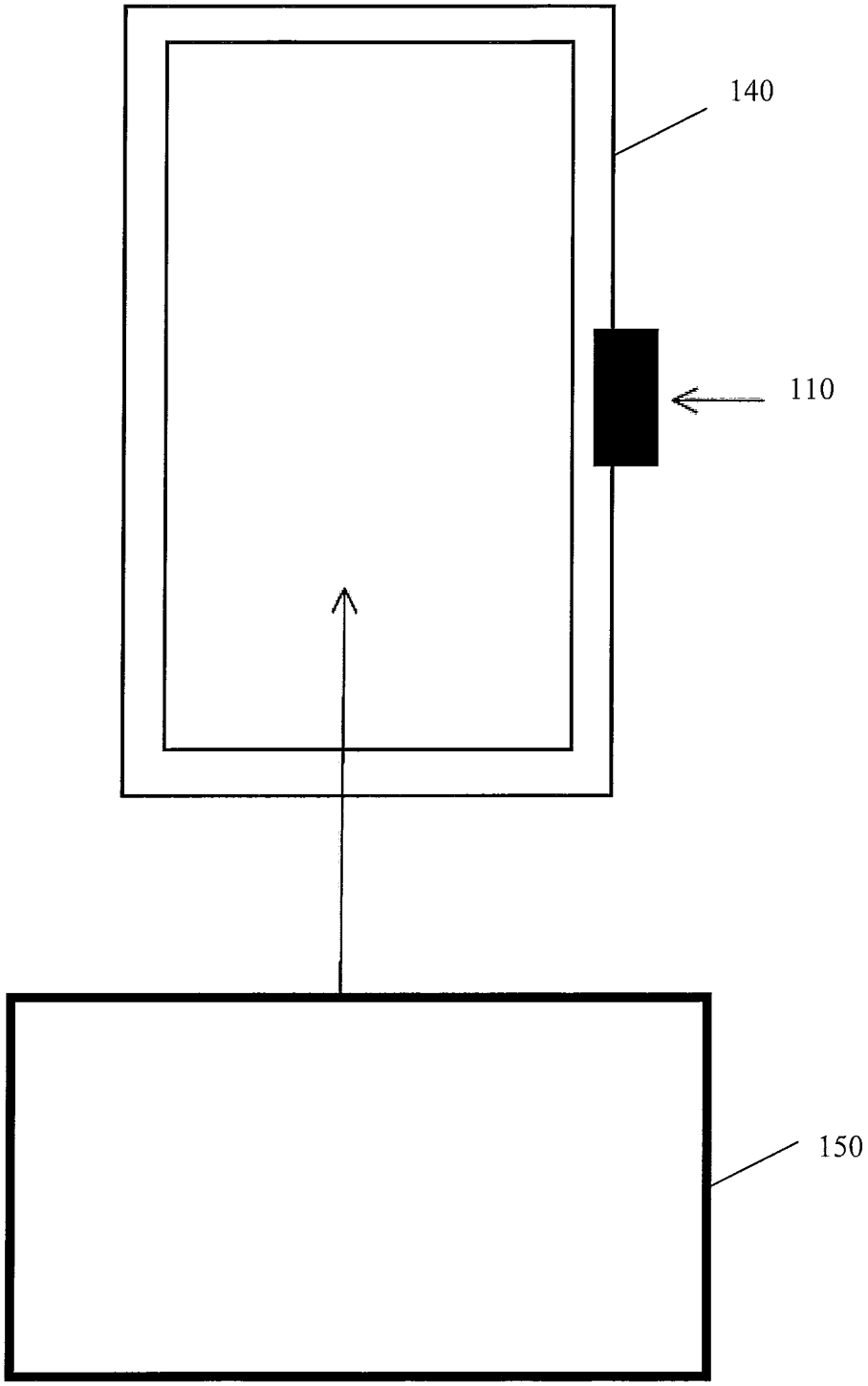
FIG. 6 is a top view of the paper tray locking insert access panel in accordance with one embodiment.

With reference to FIG. 6, the locking insert 140, in accordance with one embodiment, measures approximately 2" L×1¼" W with a clip on a length edge that snaps flush into the paper tray 60 like that which is common to a conventional battery compartment access door or cover. The opposite (upward facing) side has a ⅛" tall perimeter collar measuring 1¾" L×1" W to hold the paper pack 150.

With continuing reference to FIG. 6, the dispensing paper pack 150 includes mini paper sheets pre-assembled in a box measuring 1¾" L×1" W×1¼" H wherein the individual sheets (e.g., 100) of dispensing paper are stacked in an opposing interlocking order so that the withdrawal of one of the paper access opening pulls the next one into the paper access opening at the precipus of the top of the cap.

The cap fits to the base of the device by placing it over the recessed flange at the top of the base. The device may be constructed of metal or plastic and could incorporate two or more securing clips mounted to the outside flange wall for additional structural integrity. The cap has a slit traversing the top across its peak to allow access to, and the withdrawal, of small paper sheets to wrap consumed chewing gum for disposal. These sheets of paper are prearranged in an independent paper pack component and are self-loading so that the withdrawal of one pulls the next one up through the access slit on the cap. The paper pack mounts to the underside of the locking insert located in and recessed flush to the paper tray. The paper tray is attached to a recessed lip located on the inside bottom of the cap. A rubber gasket with slits cut in an "X" pattern is mounted to a recessed lip on the top inside of the base below the flange providing access for disposal of the wrapped gum into the cavity disposal area of the base below the rubber gasket. The base is emptied of its contents by the removal of a plastic plug located on the underside of the base.

In alternate embodiments, the securing clips can be eliminated. In such embodiments, the flange located at the top of the base and the inside bottom of the cap can be threaded. The cap is secured to the base by screwing or forcing these components together or apart. In an alternate embodiment shown in FIG. 7, the cap and the base are coupled using a threaded connection 160. In lieu of the smooth or plain flange collar design of the base component, the base in the alternate embodiment shown in FIG. 7 is threaded at its top on the flange collar, and the cap is threaded at its bottom inside so that the base and cap would screw together eliminating the optional design for incorporating the securing clips.

In operation, the user withdraws a single paper sheet from the paper pack through the slit on the top of the cap, and another is drawn up through the slit and reloaded. The user then wraps consumed chewing gum in the paper sheet. In the next step, the user lifts or unscrews the cap from the base and pushes the wrapped gum down through the "X" pattern slits cut in the rubber gasket mounted to the base and into the disposal area below the gasket. The user may remove the plug located on the underside of the base to empty the contents of the base. The locking insert on the paper tray is removed to replace the paper pack and reinserted.

While various embodiments of the device for the disposal of consumed chewing gum were provided in the foregoing description, those skilled in the art may make modifications and alterations to these embodiments without departing from the scope and spirit of the invention. For example, it is to be understood that this disclosure contemplates that, to the extent possible, one or more features of any embodiment can be combined with one or more features of any other embodiment. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A device for the disposal of consumed chewing gum, the device comprising:

a base having a hollow cylindrical form with an open top separated from an open bottom, the base defining a disposal area in an internal cavity for receiving consumed chewing gum;

a cap having a hollow cylindrical form with an open top separated from an open bottom, the cap defining an internal cavity for receiving a paper pack;

a flange collar provided on the open top of the base for receiving and securing the open bottom of the cap;

a gasket adapted for engaging the open top of the base;

a removable plug for enclosing the open bottom of the base; and a paper tray for enclosing the open bottom of the cap.

2. The device of claim 1, wherein the gasket includes a plurality of slits extending radially outward from the center of the gasket to create an opening through which the consumed chewing gum is disposed into the disposal area of the base.

3. The device of claim 1, wherein the gasket includes a channel on its outer circumference for engaging a lip of the open top of the base.

4. The device of claim 1, wherein the removable plug has a tapering shape with a central ring and a top lip that overlaps the open bottom of the base.

5. The device of claim 1, further comprising a plurality of securing clips attached to the flange collar for securing the cap to the base.

6. The device of claim 1, further comprising a recessed lip on the open top of the base for accommodating the gasket.

7. The device of claim 1, wherein the open top of the cap has a rectangular slit.

8. The device of claim 1, wherein the paper tray includes a removable locking insert adapted for engaging the paper tray.

9. The device of claim 1, wherein the paper pack has a plurality of individual sheets.

10. The device of claim 1, wherein the open bottom of the cap includes a recessed lip to accommodate the attachment of the paper tray.

11. The device of claim 1, wherein the flange collar is threaded for threadably engaging the cap to the base.

12. The device of claim 1, wherein the device has an elliptical paraboloid shape tapering inwards from the open bottom of the base to the open top of the cap.

13. A device for the disposal of consumed chewing gum, the device comprising:

a base having a hollow cylindrical form with an open top separated from an open bottom, the base defining a disposal area in an internal cavity for receiving consumed chewing gum;

a cap having a hollow cylindrical form with an open top separated from an open bottom, the cap defining an internal cavity for receiving a paper pack;

a flange collar provided on the open top of the base for receiving and securing the open bottom of the cap;

a gasket adapted for engaging the open top of the base;

a removable plug for enclosing the open bottom of the base; and a paper tray for enclosing the open bottom of the cap, wherein the gasket includes a plurality of slits extending radially outward from the center of the gasket to create an opening through which the consumed chewing gum is disposed into the disposal area of the base, wherein the paper tray includes a removable locking insert adapted for engaging the paper tray, and wherein the paper pack has a plurality of individual sheets.

14. A method for the disposal of consumed chewing gum comprising the steps of:

a) providing a device for the disposal of consumed chewing gum, the device comprising:

a base having a hollow cylindrical form with an open top separated from an open bottom, the base defining a disposal area in an internal cavity for receiving consumed chewing gum;

a cap having a hollow cylindrical form with an open top separated from an open bottom, the cap defining an internal cavity for receiving a paper pack;

a flange collar provided on the open top of the base for receiving and securing the open bottom of the cap;

a gasket adapted for engaging the open top of the base;

a removable plug for enclosing the open bottom of the base; and a paper tray for enclosing the open bottom of the cap;

b) withdrawing a single paper sheet from the paper pack through the open top of the cap;

c) wrapping consumed chewing gum in the paper sheet;

d) removing the cap from the base;

e) placing the wrapped gum through one or more slits cut in the gasket; and f) depositing the wrapped gum into the disposal area of the base.

15. The method of claim 14, wherein the gasket includes a channel on its outer circumference for engaging a lip of the open top of the base.

16. The method of claim 14, further comprising a plurality of securing clips attached to the flange collar for securing the cap to the base.

17. The method of claim 14, wherein the removable plug has a tapering shape with a central ring and a top lip that overlaps the open bottom of the base.

18. The method of claim 14, further comprising a plurality of securing clips attached to the flange collar for securing the cap to the base.

19. The method of claim 14, wherein the flange collar is threaded for threadably engaging the cap to the base.

20. The method of claim 14, wherein the device has an elliptical paraboloid shape tapering inwards from the open bottom of the base to the open top of the cap.

* * * * *